US005681389A

United States Patent [19]

Lobo et al.

[11] Patent Number: 5,681,389

[45] Date of Patent: Oct. 28, 1997

[54] GRAVURE COATING FEED APPARATUS

[75] Inventors: Rukmini Bezbaruah Lobo, Webster; Kenneth John Ruschak, Rochester; Barry Anthony Fitzgerald, Holley, all of N.Y.

[73] Assignee: Eastman Kodak Company, Rochester, N.Y.

[21] Appl. No.: 594,203

[22] Filed: Jan. 31, 1996

[51] Int. Cl.[6] ..... B05C 1/00; B05C 1/06; B05C 1/08

[52] U.S. Cl. ..... 118/212; 118/211; 118/249; 118/261; 118/DIG. 4

[58] Field of Search ..... 118/DIG. 4, 211, 118/212, 249, 261

[56] References Cited

U.S. PATENT DOCUMENTS

| | | | |
|---|---|---|---|
| 1,921,953 | 8/1933 | Stephens . | |
| 2,641,220 | 6/1953 | Weber et al. . | |
| 3,339,485 | 9/1967 | Rytterholm . | |
| 3,936,549 | 2/1976 | Kohler et al. . | |
| 4,158,333 | 6/1979 | Navi . | |
| 4,352,670 | 10/1982 | Georgiades . | |
| 4,373,443 | 2/1983 | Matalia et al. . | |
| 4,466,993 | 8/1984 | Hsu et al. | 427/44 |
| 4,844,002 | 7/1989 | Yasui et al. | 118/259 |
| 5,233,922 | 8/1993 | Stirbis et al. . | |

*Primary Examiner*—Donald E. Czaja
*Assistant Examiner*—Jacqueline A. Ruller
*Attorney, Agent, or Firm*—Clyde E. Bailey, Sr.

[57] ABSTRACT

A coating feed apparatus and method (10) for depositing a uniform overflow curtain-like layer of coating composition (c) to a gravure surface (14) has a reservoir (14) and means for delivering the coating composition to the gravure surface (14). The reservoir (14) has a base (24) sloped upwardly from a rear wall (22). A widthwise lip (40) is directed generally downwardly towards the gravure surface (14). Widthwise lip (40) and the undercut portion (48) together enable the coating composition (c) exiting the outlet end (26) of the reservoir (12) to overflow downwardly across widthwise lip (40) in a uniform curtain-like layer (32) towards the gravure surface (14) without creating a backflow of coating composition along the base (24).

11 Claims, 2 Drawing Sheets

GRAVURE COATING FEED APPARATUS

DESCRIPTION

1. Field of the Invention

The invention relates to a gravure coating feed apparatus and method. More particularly, the invention concerns a gravure coating feed apparatus and method which deposits a uniform curtain-like layer of coating composition to a gravure print surface without producing associated coating effects, such as flow lines and flow patterns.

2. Background of the Invention

Gravure print surfaces, for instance gravure cylinders, are a common means of supplying liquid compositions to webs. U.S. Pat. No. 4,373,443 describes the use of a gravure cylinder to provide ink in newspaper presses. Engraved upon the surface of the gravure cylinder are cells, which retain the liquid composition after being immersed in the reservoir. A doctor blade scrapes excess liquid composition from the surface of the gravure cylinder, such that the cylinder delivers a precise amount of liquid to a second surface upon contact. A number of distinct feed apparatus types which produce a variety of coating flow patterns are used to coat a gravure cylinder.

One common means of coating a gravure cylinder is a feed pan, similar to U.S. Pat. No. 3,936,549. The pan is constructed to hold a supply of the liquid composition with a means to maintain the liquid level. The gravure cylinder, while partially immersed in the reservoir, rotates to fill the cells and transfer the composition to a web. Drawbacks of the feed pan design include liquid waste due to large holdup volumes and the creation of "flow lines" in the coating. "Flow lines" occur when the gravure cylinder surface initially dips into the liquid composition and contacts a region with impurities. The impurities include air bubbles, globules of concentrated dye and binder, and pieces of partially dried foam. The feed pan design is conducive for the formation of stagnation regions where impurities may form and collect. Experiments with alternative pan designs were unsuccessful in eliminating "flow lines," particularly at high coating speeds.

An additional common means to coat the gravure cylinder is a reverse doctor-pond feed, as seen in U.S. Pat. No. 4,158,333. The pond feed, which may be open or enclosed, is centered at the nine o'clock position with a reverse angled doctor blade at the seven o'clock position. The reverse doctor blade scrapes the surface of the gravure cylinder as the surface exits the reservoir and the doctored cells pass through three quarters of a rotation before reaching the impression nip. The volatile solvents in the liquid composition remaining in the cells evaporate or "dry in" and create a leading edge pattern on the second cylinder or web. Additionally, foam generation on the pond surface may lead to "flow line" problems as with the feed pan method.

Another alternative apparatus to coat the gravure cylinder is an X-hopper coater, which is an extrusion device. A high degree of accuracy and precision are required to position the device relative to the gravure cylinder. The feed applies a thick (2–5 mils) coating to the cylinder at the three o'clock position. The surface remains wetted until reaching the doctor blade at the standard 10 o'clock position. The disadvantage of the design is primarily the cost associated with constructing a precise metering slot and a high pressure metering pump. The design is also inadequate for startup procedures, where the feeder coats the cylinder while the doctor blade and impression nip are disengaged. Under those conditions the excess coating solution would pool and splash at the hopper's lip.

More recent methods developed to coat the gravure cylinder for thermal donor media melts is the feedbar pond, the patent application for which is pending. It combines a knife coater with a puddle or pond feed with a continuous solution delivery means, an overflow and recycle. The knife or feedbar spacing provides a means for metering the coating of solution on the gravure cylinder, as it exits the bottom of the pond, at an three o'clock position, prior to being doctored off at the 10o'clock position. The main disadvantages of this device is that at high speeds, the pond becomes turbulent and wavy, forming standing oscillating waves and eddies, which can cause 'flowline' defects. It also fails to uniformly wet the gravure cylinder at high speed and viscosity's due to air entrainment at the air-cylinder-solution interface, causing 'flowpattern' defects.

The problems identified and solved by the present invention include an apparatus which supplies a uniform curtain-like layer of coating to a gravure cylinder at high coating speeds. More specifically, the apparatus of the invention supplies a coating solution to the gravure cylinder without coating defects associated with high coating speeds such as 'flowlines' and 'flowpatterns', and at the same time increases the onset speed of wetting failure due to air entrainment at the cylinder-liquid-air interface. Moreover, the apparatus of the invention reduces waste and costs associated with the gravure coating process.

SUMMARY OF THE INVENTION

It is, therefore, an object of the invention to provide a coating feed apparatus that deposits coating composition onto a gravure surface without coating effects such as flowlines and flowpatterns.

Another object of the invention is to provide a coating feed apparatus that delivers coating composition in a curtain-like overflow layer to a gravure surface.

It is a feature of the apparatus of the invention that a reservoir for containing the coating composition includes an upwardly sloped base terminating in an outlet end configured to produce a curtain-like overflow coating layer for deposition onto the gravure surface.

It is an advantageous effect of the invention that when the coating composition is delivered from the reservoir and then deposited onto the gravure surface, coating effects, such as flowlines and flow patterns are eliminated. Accordingly, for accomplishing these and other objects, features and advantages of the invention, there is provided, in one aspect of the invention, an apparatus for depositing a coating composition onto a gravure surface. A reservoir containing the coating composition includes opposing sidewalls, a rear wall, a base having lateral edges connecting the sidewalls and a first end portion connecting the back wall with the sidewalls. The base slopes upwardly from the rear wall to form an outlet end or weir at a second end portion opposite the first end portion. Further, the outlet end is configured to deliver a uniform overflow curtain-like layer of coating composition from the outlet end or weir onto the gravure surface. In this embodiment, moreover, means is provided for delivering the coating composition in the reservoir through the outlet end. Finally, at least one baffle is disposed in the reservoir downstream of the outlet end. According to the embodiment of the invention, the baffle includes a first portion attached to the base and a second portion directed substantially toward the rear wall of the reservoir.

In another aspect of the invention, a method is provided for depositing a coating composition onto a gravure surface which includes the steps of providing a coating composition, such as coating compositions described in U.S. Pat. Nos. 4,695,287; 4,700,207; and 4,698,651; hereby incorporated herein by reference, and a reservoir having a base sloped upwardly towards the outlet end, the outlet end being configured to form an uniform overflow curtain-like layer of coating composition. Also important to this embodiment is the step of providing means for delivering the coating composition from the reservoir to the gravure surface. Within this step, the coating composition in an uniform overflow curtain-like layer exits the outlet end of the reservoir, across the widthwise lip and finally deposits onto the gravure surface.

BRIEF DESCRIPTION OF THE DRAWINGS

The foregoing as well as other objects, features and advantages of this invention will become more apparent from the appended Figures, wherein like reference numerals denote like elements, and wherein.

DETAILED DESCRIPTION OF THE INVENTION

Figure 1:
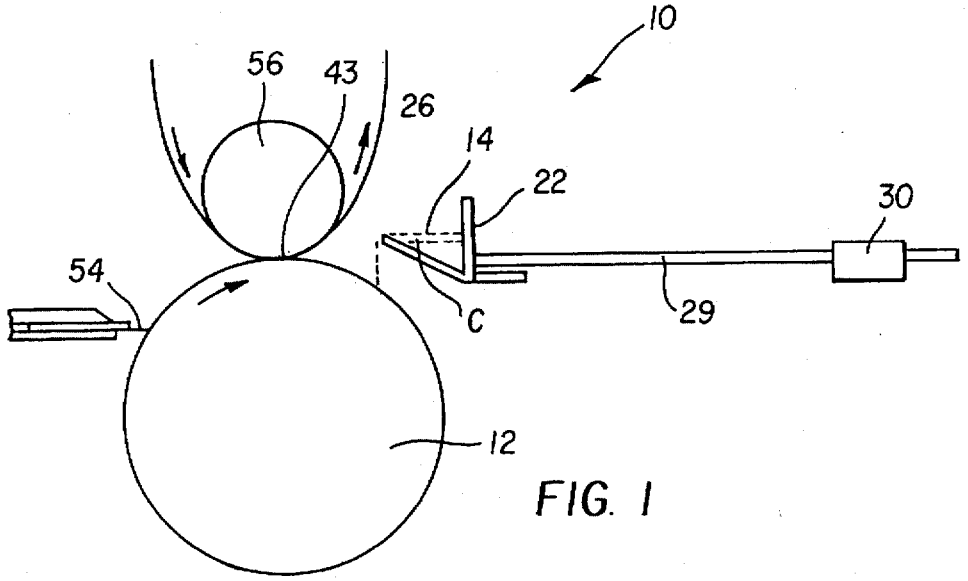
FIG 1. Is a schematic view of the apparatus of the invention.
Figure 2:
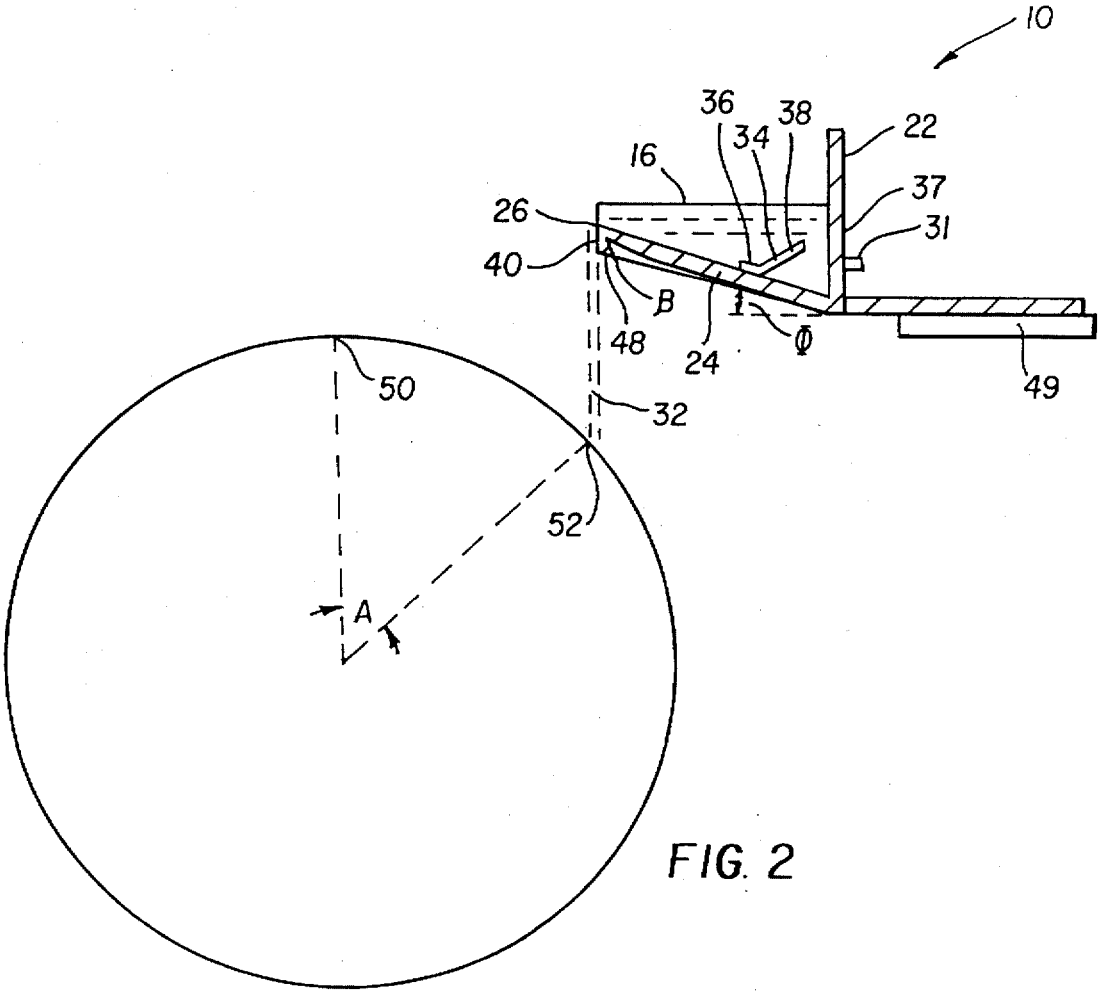
FIG 2. Is a side partially enlarged section view along line 2—2 of FIG. 1.
Figure 3:
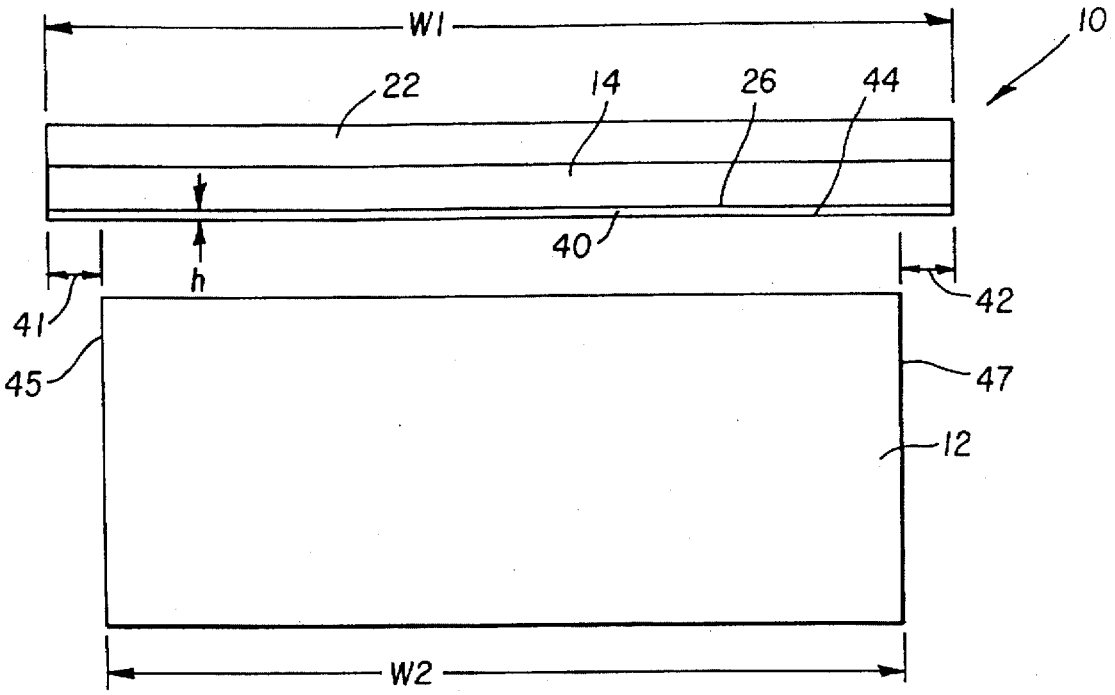
FIG 3. Is a front plane view of the apparatus showing the relationship between the weir and gravure surface; and, FIG 4. Is a comparison of air entrainment speed limit of the coating feed apparatus of the invention.

Turning now to the drawings, and more particularly to FIGS. 1–3, the apparatus 10 for depositing coating composition (c) onto a gravure surface 12 is illustrated. According to FIG. 1, the apparatus 10 comprises a reservoir 14 for containing the coating composition (c). Reservoir 14 has opposing similar sidewalls 16 (only one shown) and a rear wall 22. In FIG. 2, base 24 connects with sidewalls 16 and with the rear wall 22. In FIG. 2, it is important to the invention that base 24 slopes upwardly from the rear wall 22 to form an outlet end or weir 26. Moreover, the outlet end 26, defining a coating weir, is configured to deliver a uniform overflow curtain-like layer of coating composition (c) from the reservoir 14 downwardly onto the gravure surface 12.

Base 24 of reservoir 14, as indicated, is sloped upwardly from the rear wall 22, preferably by an angle ($\phi$) up to about 20 degrees for both optimal capacity in the reservoir 14 as well as for preventing unpredictable and otherwise uncontrollable migration of the curtain-like layer 32 from a downwardly flow plane. We have found that slopes somewhat greater than 20 degrees are not as efficient for eliminating the migration tendency of the curtain-like coating layer 32.

As shown in FIG. 1, apparatus 10 further includes means, preferably a pump, 30, for delivering the coating composition (c) from a source (not shown) through preferably a center fed supply line or pipe 29, through an inlet end 31 of the reservoir 14, and then into the reservoir 14 before passing through the outlet end 26. The coating composition (c) then flows across the outlet end 26 in an uniform overflow curtain-like layer 32, as described below, before depositing onto the gravure surface 12.

According to FIG. 2, at least one baffle 34 is disposed in the reservoir 14 downstream of the outlet end 26. Baffle 34, preferably has a first portion 36 attached to the base 24 and a second portion 38 directed substantially toward the rear wall 22 of the reservoir 14. This arrangement of the baffle 34 minimizes turbulent flow and eddy currents in the reservoir 14 when the coating composition (c) is being forced through an inlet port 37 and then into and out of the reservoir 14. We prefer using only one baffle 34 to reduce the turbulent entrance effects in the reservoir 14.

In FIGS. 1–3, outlet end or weir 26 has a widthwise lip 40 extending vertically downwardly toward the gravure surface 12. Portions 41, 42 of widthwise lip 40 extend beyond a respective opposing end edges 45, 47 of the gravure surface or cylinder 12, as shown in FIG. 3. It is important to the invention that width ($w_1$) of outlet end 26 is somewhat greater than the width ($w_2$) of the gravure cylinder 12. Preferably widthwise lip 40 has a height (h) of about 0.50 inches ( 1.27 cm) measured from the outlet end 26 to end edge 44 of lip 40. According to FIG. 3, end edge 44, which is in close proximity to the gravure surface 12, has an undercut portion 48 angled upwardly towards the base 24 and away from the widthwise lip 40. This preferred outlet end 26 configuration enables the coating composition (c) exiting the reservoir 14 to overflow downwardly across the vertical widthwise lip 40 before being deposited onto the gravure surface 14. The undercut portion 48 has a length (1) preferably not less than about 1.5 inches ( 3.81 cm), and has an angle $\beta$ preferably about 10 degrees to about 40 degrees away from vertical widthwise lip 40 to provide a pinning point for the curtain-like coating meniscus, and to prevent migration of the curtain like coating layer 32.

In an alternative embodiment, reservoir 14 may be equipped with a shield (not shown) which may be arranged to extend along the widthwise curtain-like layer 32. The shield would prevent excessive evaporation of a volatile coating composition in reservoir 14.

Moreover, reservoir 14 may be arranged on an adjustable mount 49 in apparatus 10 (shown clearly in FIG. 2) to either vertically or horizontally reposition the weir 26 relative to the gravure surface 12. Being able to position the weir 26 enables the operator to set and control a desired curtain-like application deposit point, and height, angle and flowrate of the curtain-like coating layer exiting the lip 40 and depositing onto the gravure surface 12. Experience indicates that end edge 44 of lip 40 and gravure surface 12 should be spatially separated by a distance of at least 2 inches ( 9.08 cm). Also, the coating flow angle (a), measured from the top 'dead' center 50 of the gravure surface 12 to the coating deposition point 52 on the gravure surface 12, should not exceed about 55 degrees. Setting of these parameters insures that the gravure surface 12 is wetted immediately downstream of the impression nip 43 (FIG. 1).

Figure 4:
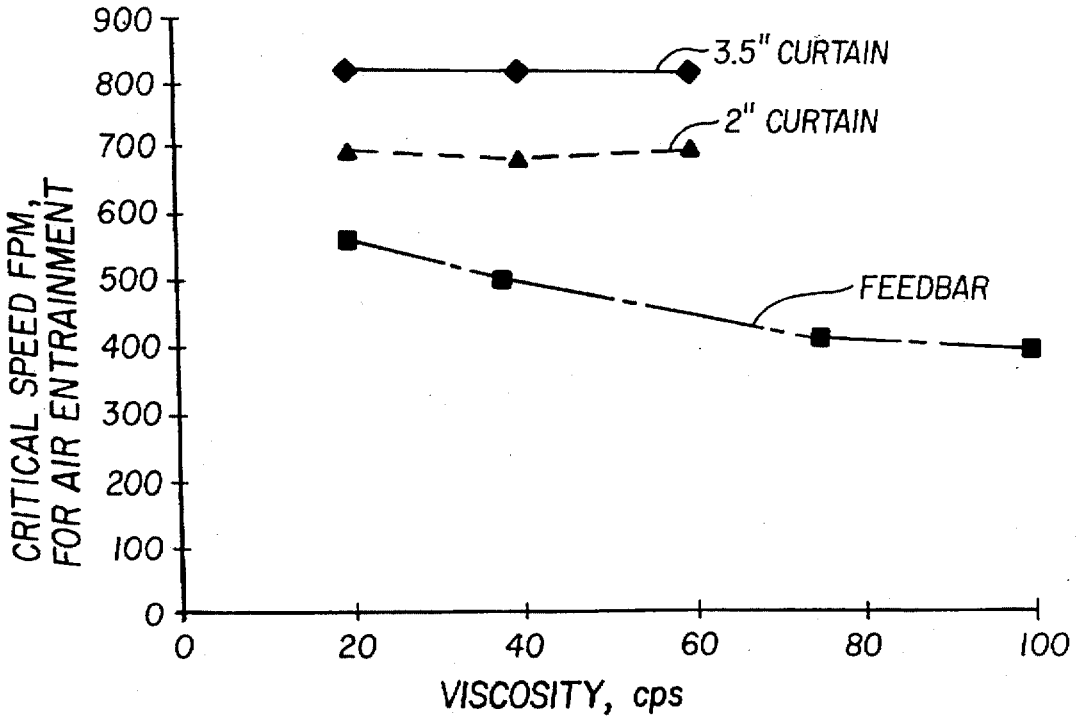

As indicated, it is important to the invention that a uniform, overflow curtain-like layer 32 of coating composition (c) is formed before exiting the weir 26 and depositing onto the gravure surface 12. It is our experience that the curtain-like coating layer 32 is robust to gravure coating process startup and idling conditions, especially when conditions indicate that the gravure cylinder 12 must remain wet, with the doctor blade 54 and impression cylinder 56 disengaged. Further, the use of forming and depositing a curtain-like layer coating onto a gravure surface 12, such as illustrated in FIGS. 1–2, has heretofore not been known to solve problems associated with any flow separation, stagnation region and eddies, typically seen with any roll coating feed system at increasingly higher production coating speeds. Stagnation regions and eddy currents in the coating composition flow where impurities and bubbles form, are thought to also give rise to 'flow line' type defects (as discussed previously) on the coating layer deposited on the gravure surface 12. Accordingly, it has been our observation that the curtain-like coating feed apparatus 10 of the invention unexpectedly provides a coating deposition process which virtually eliminates flow separation and stagnations regions, thereby eliminating the possibility of occurrence of 'flow line' defects Furthermore, it is well known that the momentum of the curtain-like overflow layer of coating composition (c) depositing onto the gravure cylinder 12 provides gravitationally assisted deposition of the coating composition onto the gravure cylinder 12. This phenomenon appears to help in displacing the air entrained by the gravure cylinder 12 at higher speeds by raising the critical speed at which wetting failure and hence 'flowpatterns' appear on the gravure surface 12. According to FIG. 4, a comparison is presented of the air entrainment speed limit of the curtain-coating apparatus of the invention and the feedbar pond system typically found in the prior art. The results suggest that by using the curtain coating apparatus 10 of the present invention, it is now possible to coat at higher coating speeds than ever before.

Additionally, we have observed, on the one hand, that the metered excess of coating composition (c) depositing on the gravure cylinder 12 by the curtain-like overflow layer is thin enough that it minimizes splashing at the doctor blade 54 at relatively high speeds. On the other hand, it is our observation that the coating deposition on the gravure surface 12 is thick enough to prevent excessive evaporation, which causes 'drying in' defects in the case of volatile solvents.

Parts List

10 . . . apparatus
12 . . . gravure surface or cylinder
14 . . . reservoir/gravure surface
16 . . . sidewalls of base
22 . . . rear wall of base
24 . . . base
26 . . . outlet end or weir
29 . . . pipe
31 . . . inlet end
32 . . . curtain-like coating layer
34 . . . baffle
36 . . . first portion
37 . . . inlet portion
38 . . . second portion
40 . . . vertical widthwise lip
41 . . . extended widthwise portions
42 . . . extended widthwise portions
43 . . . impression nip
44 . . . end edge
45 . . . opposing end edges
47 . . . opposing end edges
48 . . . undercut portion
49 . . . adjustable mount
50 . . . top 'dead' center
52 . . . deposition point
54 . . . doctor blade
56 . . . impression cylinder The invention has therefore been described with reference to certain embodiments thereof, but it will be understood that variations and modifications can be effected within the scope of the invention.

We claim:

1. In combination, an apparatus for depositing a coating composition onto a gravure surface, the combination comprising:

a reservoir for containing said coating composition, said reservoir having opposing sidewalls, a rear wall, and a base connecting said sidewalls and said rear wall, said base being sloped upwardly from said rear wall to form an outlet end in proximity to said gravure surface, said outlet end being configured to deliver a gravitational assisted uniform curtain of coating composition from said outlet end onto said gravure surface;

means for delivering the coating composition in said reservoir through said outlet end; and, at least one baffle disposed in said reservoir downstream of said outlet end.

2. The apparatus recited in claim 1, wherein said outlet end has a widthwise lip extending generally downwardly toward said gravure surface, said widthwise lip terminating with an end edge, said end edge having a undercut portion angled upwardly towards said base.

3. The apparatus recited in claim 2, wherein said undercut portion has an angle $\beta$ of about 10 degrees to about 40 degrees relative to said vertical widthwise lip.

4. The apparatus recited in claim 2, wherein said vertical widthwise lip has a height of about 0.50 inches (1.27 cm).

5. The apparatus recited in claim 1, wherein said base portion is sloped upwardly from said rear wall by up to about 20°.

6. The apparatus recited in claim 1, wherein said outlet end has a width ($w_1$), said gravure surface has a width ($w_2$), and, wherein ($w_1$) somewhat larger than ($w_2$).

7. The apparatus recited in claim 1, further comprising means for adjustably moving said reservoir generally vertically or horizontally relative to said gravure surface, said adjustably moving means further providing means for leveling said reservoir relative to said gravure surface so as to generally maintain a consistent coating relationship between said reservoir and said gravure surface.

8. The apparatus recited in claim 1, wherein said curtain-like coating composition layer overflows from said outlet end downwardly across said vertical widthwise lip and then onto said gravure surface.

9. The apparatus recited in claim 2, wherein said end edge of said widthwise lip and said gravure surface is spatially separated by a distance greater than about 2 inches (9.08 cm).

10. The apparatus recited in claim 1, wherein said undercut portion of said lip has a length greater than about 1 inch (2.54 cm).

11. The apparatus recited in claim 1, wherein said gravure surface is cylindrical.

* * * * *